United States Patent [19]

Ritsko et al.

[11] 4,233,063

[45] Nov. 11, 1980

[54] PROCESS FOR PRODUCING COBALT POWDER

[75] Inventors: Joseph E. Ritsko; John J. Culkin; Martin B. MacInnis; Howard L. Acla, all of Towanda, Pa.

[73] Assignee: GTE Products Corporation, Stamford, Conn.

[21] Appl. No.: 38,972

[22] Filed: May 14, 1979

[51] Int. Cl.[2] ..... C22B 23/04

[52] U.S. Cl. ..... 75/0.5 AA; 75/119; 423/143

[58] Field of Search ..... 75/0.5 AA, 119; 423/143

[56] References Cited

U.S. PATENT DOCUMENTS

| | | | |
|---|---|---|---|
| 2,826,499 | 3/1958 | Schlecht et al. | 75/119 X |
| 2,879,137 | 3/1959 | Bare et al. | 75/119 X |
| 3,928,530 | 12/1975 | Bakker et al. | 75/119 X |
| 4,093,450 | 6/1978 | Doyle et al. | 75/0.5 AA |
| 4,108,640 | 8/1978 | Wallace et al. | 75/0.5 AA |

FOREIGN PATENT DOCUMENTS 1583864 2/1972 Fed. Rep. of Germany .

*Primary Examiner*—G. Ozaki

*Attorney, Agent, or Firm*—Robert E. Walter

[57] ABSTRACT

Cobalt is recovered from by-product streams from a basic process by heating the by-product streams containing ammonia for a sufficient period of time at a pH of about 8 to about 10 to produce an ammonia enriched vapor and an aqueous mixture comprising a solution substantially free of ammonia and another cobalt containing precipitate. The basic process is the type wherein cobalt ions in solution are complexed with ammonia in the presence of halide ions to form an ammine halide solution which is digested to form a cobalt containing precipitate. The precipitate is subsequently reduced to form a cobalt metal powder.

9 Claims, No Drawings

PROCESS FOR PRODUCING COBALT POWDER

CROSS REFERENCE TO RELATED APPLICATIONS

Co-pending U.S. Pat. application Ser. No. 010,769, filed Feb. 9, 1979, a continuation of Ser. No. 911,595, now abandoned, describes a method for obtaining fine particle size cobalt by hydrogen reduction of a precipitate obtained from a cobalt pentammine chloride solution. The co-pending applications relating to the production of fine metal cobalt filed concurrently herewith include Ser. No. 038,973, relating to mother liquor treatment, Ser. No. 038,968 utilizing an ion exchange resin during cobalt liquor processing, Ser. No. 038,971 relating to the use of a metallic hydroxide to form a cobalt containing precipitate, and Ser. No. 038,970 relating to a method for producing cobaltic hexammine compounds and cobalt metal powder therefrom.

TECHNICAL FIELD

This invention relates to an improved method for obtaining cobalt metal powder from a cobalt source by the thermal reduction of a precipitate obtained by the digestion of a cobalt ammine halide solution. More particularly, cobalt is recovered from aqueous solutions which are byproduct streams from the basic cobalt production process.

BACKGROUND

U.S. Pat. No. 4,093,450 to Doyle et al. describes a method for producing fine particle size cobalt metal powder by the hydrogen reduction of cobalt oxide obtained from a cobalt pentammine carbonate solution. The precipitate is formed by heating the solution to drive off ammonia and carbon dioxide to form a precipitate of cobalt oxide. This method requires a solution of approximately 4 grams per liter of cobalt to produce a size metal powder having a particle size less than one micron. Note that the final resulting particle size is highly dependent on the concentration of cobalt employed in the aqueous solution.

U.S. Pat. No. 2,879,137 to Bare et al. discloses the treatment of ammoniacal ammonium carbonate solution, obtained from leaching and/or containing nickel wherein the cobalt present in the cobaltic state is treated with an alkali metal or alkaline earth metal hydroxide under controlled temperature conditions to precipitate the nickel free of cobalt.

U.S. Pat. No. 3,928,530 to Bakker et al. discloses a method for the separation of nickel and cobalt by forming pentammine chloride complexes and solution containing a high concentration of ammonium chloride, and precipitating cobalt pentammine chloride.

In German Pat. No. 1,583,864, cobalt is recovered from scrap by digestion of the scrap in hydrochloric acid and magnesium chloride solution, followed by removal of iron and chromium impurities by precipitation at moderately acid pH followed by extracting a cobalt chloride complex with a long chain tertiary ammine in an aromatic solvent.

U.S. Pat. No. 4,108,640 to Wallis discloses a method for recovering metallic cobalt from an aqueous ammonical solution wherein the solution is contacted with a water immiscible liquid ion exchange reagent dissolved in an inert organic diluent to selectively extract the other metal from the solution and produce an organic extract loaded with the other metals and an aqueous cobalt bearing raffinate substantially free of the other metals.

DISCLOSURE OF THE INVENTION

In accordance with the present invention, there is provided an improvement in a basic cobalt powder production process of the type comprising the steps of digesting a cobalt source to form cobalt ions in solution, complexing said cobalt ions with ammonia in the presence of halide ions to form a cobalt ammine halide solution, and digesting said cobalt ammine halide solution in the presence of ammonia to form a cobalt containing precipitate, separating said cobalt containing precipitate from the resulting solution and heating said cobalt containing precipitate in a reducing atmosphere to obtain a cobalt metal powder wherein the improvement comprises heating said resulting solution at a pH of from about 7.5 to about 14 for a sufficient period of time and at a suitable temperature to produce an ammonia enriched vapor and aqueous mixture comprising an ammonia free solution and another cobalt containing precipitate, and separating said other cobalt containing precipitate from said ammonia free solution.

Also, in accordance with the present invention, ammonia is removed from other byproducts streams of the basic process and the resulting cobalt containing precipitates formed are recycled and added to the cobalt source of the basic process.

DETAILED DESCRIPTION

The method for producing fine particle size cobalt metal powder, herein referred to as the "basic" method, of which the present invention is an improvement, as described and claimed in co-pending patent application Ser. No. 010,769, filed Feb. 9, 1979, and assigned to the present assignee.

Aqueous solutions containing cobalt from a variety of sources may be utilized in the method of the present invention. Such solutions may be derived from sludges and leach solutions from cemented carbide or tungsten recovery operations which may result from the digestion of scrap and impure powders. Typical leach solutions are obtained from leached oxidic materials, such as ores, oxidized sulfite concentrates, hydroxide concentrates and the like. The starting solutions may contain a variety of anions and cations such as iron, manganese, copper, aluminum, chromium, magnesium, nickel, calcium, sodium, potassium, etc. It is contemplated that the cobalt ion containing starting solution may be formed from byproduct streams from various hydrometallurgical processes.

The digested cobalt source comprising an aqueous solution containing cobalt ions are complexed with ammonia in the presence of halide ions to form a cobalt ammine halide solution. The basic process is not limited by cobalt ion concentration so that the original solution containing the digested cobalt source may have a cobalt concentration up to 60 or even up to 150 grams per liter of cobalt. To complex cobalt ions with ammonia to form an aqueous cobalt ammine halide solution, ammonia and halide ions are present in solution from any convenient source. Ammonia may be present or formed in a variety of ways such as bubbling ammonia gas through the solution or adding ammonium hydroxide directly thereto. The halide ions may be present such as would occur if the original cobalt source is digested by hydrochloric acid or if a halide salt or acid halide is added to the solution.

It is desirable to oxidize cobalt ions present in the divalent state in the starting solution to the trivalent state. Conventional oxidation methods may be utilized. The solution containing cobalt ions, halide ions and ammonia may be contacted with a gas containing oxygen such as by aeration for a sufficient period of time to substantially convert the cobalt ions to the trivalent state. Other oxidizing methods known such as adding sodium hypochlorite may be used.

Oxidation of a cobaltous ion to cobaltic ion results in the formation of cobaltic ammine ions in the solution containing cobalt ammonium and halide ions. At least a portion of the cobaltic ammine ions are preferably present in the form of cobaltic hexammine, halocobaltic pentammine or aquocobaltic ammine having the formula $Co(NH_3)_{6-a}X_3$ wherein X is a halogen and a is 1 or 0.

In accordance with the preferred basic process, the cobalt source is digested in hydrochloric acid solution to obtain solution of about 60 to 150 grams per liter of cobalt in a 1 to 6 molar hydrochloric acid solution having a pH of about 0.1 to 1.5. Ammonium hydroxide is added to result in a concentration of about 100 to 150 grams per liter of ammonia chloride at a pH of about 8.5 to 10.0. Air oxidation of the cobaltous ion to cobaltic ions results in the formation of cobaltic ammine ions. Typical oxidation times are from about 1 to about 10 hours. The solution is also preferably heated to a moderate temperature, for example, about 40 to 80° C., in order to dissolve substantially all the cobalt ammine chloride.

Cobalt metal powder may then be obtained from the cobalt ammine halide solution by digesting the solution for about 2 to 10 hours at a temperature of about 80° C. to 105° C. to decompose the cobalt ammine halide and form a cobalt containing precipitate. From an initial starting basic pH, the pH of the solution decreases during the digesting process. The cobalt-containing precipitate is separated from the resulting solution and the precipitate is heated in a reducing atmosphere for a time and temperature sufficient to reduce the precipitate to cobalt metal powder.

The purity of the resulting metallic cobalt powders is dependent on the purity of the starting solution and certain metallic cations which may be regarded as impurities may precipitate with the cobalt and may be present in the final reduced cobalt metallic powder. Depending on the composition of the cobalt source and the purity desired for the final cobalt metal powder, several additional steps may be carried out.

For example, after the initial digestion of the cobalt source and prior to the addition of ammonia, it may be necessary to remove insoluble sludge, typically containing tantalum, titanium and tungsten from cobalt sources. The scrap or sludge sources from cemented carbide industry may contain significant amounts of insolubles. Separation of precipitates or sludges from solutions of any of the above or subsequent steps may be accomplished by filtering followed by washing the filtrate.

To remove cation impurities, the basic process may further include acidifying the cobalt ammine halide solution to form a precipitate comprising cobalt ammine halide and separating the purified cobalt ammine halide precipitate from the resulting solution containing impurities. Preferably the acidification step is carried out by adding hydrochloric acid to the solution containing cobalt ammine chlorides.

The above described purified cobalt ammine halide precipitate is separated from the solution containing impurities and dissolved in an ammonia containing solution. At this stage, it may again be desirable to remove insoluble sludge. Cation impurities other than iron in the solution are typically present in the range of about 100 parts per million to 1 weight percent at this step of the process. Iron will usually be less than 1,000 parts per million. Cationic impurities of less than 100 parts per million may be achieved by one or more optional "recrystallization" (i.e. acid precipitation followed by ammonia dissolution) of the cobalt ammine halide prior to digestion to form the cobalt-containing precipitate.

The cobalt containing precipitate formed from relatively pure cobalt ammine halide solutions as described above has a black coloration. It is believed to be an amorphous hydrated cobaltic compound. Although it is difficult to measure particle size of the precipitate, it appears that the particles are from about 10 to about 25 microns in size. Air drying the cobalt containing precipitate at a temperature of about 100° C. results in the formation of particles having an average particle size from about 2 to about 5 microns. These latter particles appear to be a hydrated cobaltic oxide having the formula $Co_2O_3.1H_2O$. Reduction of the wet and undried precipitate is typically carried out in a hydrogen atmosphere for a time of from about 1 to 6 hours at a temperature within the range of about 350° C. to 600° C.

In the above-described method, mother liquor from the acid precipitation steps and the second digestion step contain various cobalt species in solution. Such species include cobalt pentammine chloride due to the incomplete conversion of the cobalt containing precipitate, and cobalt hexammine chloride, which is formed during the formation of the pentammine species and not convert to precipitate during digestion. Other cobaltous and cobaltic species may be present. The mother liquor typically contains up to 0.5 weight percent of cobalt.

Accordingly, the present invention is an improvement of the above-described basic method wherein mother liquor from the second digestion step and any acid precipitation steps is treated to convert soluble cobalt ions in the mother liquor to a cobalt containing precipitate, and the precipitate, depending on the purity may either be reduced to cobalt metal powder or recycled by adding it to the cobalt source for repetition of the basic method.

In accordance with the improvement of the present invention, the resulting solution remaining after the formation of the cobalt containing precipitate is heated at a pH of from about 7.5 to about 14 for a sufficient period of time at a sufficient temperature to produce ammonia enriched vapor and an aqueous mixture comprising ammonia free solution and a cobalt containing precipitate. The mother liquors remaining after the formation and separation of any precipitated cobalt ammine halide and any reprecipitated cobalt ammine halide may be individually or together combined with the resulting solution remaining after the formation of the cobalt containing precipitate and processed to remove ammonia and form another cobalt containing precipitate.

The above described aqueous cobalt and ammonia containing solutions are by-product streams of the basic process and individually or collectively form a reclaim solution from which cobalt is recovered via the secondary recovery process of the present invention.

Preferably the pH of the by-product or reclaim solutions as above described which contain ammonia and cobalt are adjusted to a pH of from about 10 7.5 about 10, 14. Even more preferably the pH is adjusted to about 10. Generally, the pH of the reclaim solutions must be increased to the above mentioned pH by adding a base. Preferably an alkali metal hydroxide or alkaline earth hydroxide or salt or oxide resulting in the formation thereof in solution is added in an amount sufficient to increase the pH to the preferred pH. Due to its commercial availability, lime is preferably used.

The reclaim solutions at the proper pH are then heated to form an aqueous mixture comprising a solution free of ammonia and another cobalt containing precipitate. The latter cobalt containing precipitate may be directly reduced if it is precipitated from a solution of sufficient purity. However, more than likely, the solution from which it is precipitated contains quantities of impurities and thus it is desirable to recycle this latter precipitate to the step of the basic process wherein the cobalt containing source is digested.

This latter step of heating the reclaim solutions containing ammonia and cobalt to remove ammonia and form a cobalt containing precipitate is preferably performed in a distillation column of the type having a rectifying section and a stripping section. A typical distillation column may include a plurality of trays or be of the type packed with extended surfaces. The feed stream enters the column intermediate the upper rectifying portion and the lower stripping portion. Heat for the column is typically provided by steam entering a lower portion of the column. Once uniform conditions have been reached in the column a refluxing action occurs in the rectifying portion of the column. In the stripping portion there is a counter current contacting of rising vapors with the descending waste feed stream. A condensor connected to the reflexing portion via a conduit results in the production of a solution containing about 28 percent ammonia therein. A stream withdrawn from the bottom of the stripping section contains ammonia free solution and a precipitate containing cobalt which is filtered.

The following examples will further illustrate the specific embodiments of this invention. It should be understood, however, that these examples are given by way of illustration and not limitation. All temperatures are in degrees C. and all parts are by weight, unless otherwise indicated.

EXAMPLE

COBALT CHLORIDE SOLUTION TO CRUDE COBALT PENTAMMINE CHLORIDE

One hundred gallons of a cobalt chloride solution obtained by the digestion of scrap tungsten carbide in hydrochloric acid is diluted with deionized water to a specific gravity of 1.25 and a pH of 0 at 22° C., resulting in a concentration of about one pound of cobalt chloride per gallon of water or about 115 grams per liter of cobalt chloride. Ammonia hydroxide is then added to lower the specific gravity to about 1.038 and to raise the pH to about 9.3 at 50° C., resulting in about 240 gallons of solution. The solution is then aerated at an air flow rate of about 16 cubic feet per minute for 2 to 8 hours. The oxidized solution is then heated to 90° C. and held for 15 minutes at this temperature after which 56 gallons of hydrochloric acid are added to lower the pH to about 0.5. The solution is then digested at 80° to 90° C. for one hour. Agitation is continued throughout digestion. The digested solution is cooled to about 40° C. at which temperature the cooling water is removed, agitation is stopped and the precipitate is allowed to settle. A portion of the mother liquor is then decanted. The remaining mother liquor is then filtered to remove the precipitate and the filtered mother liquor is recombined with the decanted mother liquor.

PREPARATION OF PURE COBALT PENTAMMINE CHLORIDE

About 542 pounds of precipitate are obtained in the form of crude cobalt pentammine chloride. About 150 pounds of this crude cobalt pentammine chloride is then charged to 195 gallons of deionized water at about 60° C. and with agitation. Eighteen gallons of ammonia hydroxide are added to achieve a pH of about 10 at 30° C. Continuing agitation, the slurry is then heated to about 65° C. until the crude pentammine chloride has dissolved, resulting in 225 gallons of solution having a pH of 9.1 and a specific gravity of 1.008 to 60° C. The solution is then filtered. About 55 gallons of 30 percent hydrochloric acid are added to the filtrate to achieve 265 gallons of solution having a pH of about 0.5 at 80° C. The solution is digested for one to two hours with agitation, then cooled to about 25° to 35° C. The precipitate is allowed to settle and a portion of the mother liquor is decanted. The remaining mother liquor is filtered to remove about 113 pounds of pure crystalline cobalt pentammine chloride.

PURE COBALT PENTAMMINE CHLORIDE TO COBALT PRECIPITATE

About 135 pounds of pure cobalt pentammine chloride are added with agitation to 185 gallons of deionized water at about 60° C. With agitation, 28 gallons of ammonium hydroxide are added to achieve a pH of 10.0 at 30° C. and a total volume of 220 gallons. The solution is then agitated and heated to a temperature of 60° C. to dissolve the pure cobalt pentammine chloride. The resulting solution has a pH of 9.3 and a specific gravity of about 1.008 to 60° C. The solution is then filtered at about 40° C. and then heated to about 90° C. and digested at this temperature for six hours. The volume is maintained between 180 and 190 gallons during digestion by the addition of deionized water. At the end of digestion, the pH is about 6.0 to about 7.5 at 80° C. The cobalt precipitate is allowed to settle and a portion of the mother liquor is decanted. The slurry remaining in the tank is washed to remove chloride by adding 140 gallons of hot deionized water and 1½ gallons of ammonium hydroxide and agitating for about 5 minutes after the slurry has been heated to about 80° C. The cobalt precipitate settles, and is then removed by filtration. The cobalt precipitate is then reslurried in 70 gallons of hot deionized water, again allowed to settle and the mother liquor decanted. Filtering is again carried out.

COBALT PRECIPITATE TO COBALT METAL POWDER

The wet cobalt precipitate filtrate is reduced to cobalt metal powder by loading 200 gram batches in refractory boats and stoking the boats into a hydrogen reduction furnace at 300° to 600° C. at a stoking rate of ten minutes per boat, resulting in a total reduction time of about 1½ hours per boat.

RECLAMATION OF COBALT IN BY-PRODUCT STREAMS

The by-product streams from the above mentioned process steps are collected in a large storage tank. About 200 gallons are collected as a filtrate and decanted mother liquor from the preparation of crude cobalt pentammine chloride. About another 250 gallons are collected as filtrate from the formation of the pure cobalt pentammine chloride. An additional 220 gallons are collected from the digestion step which results in the formation of the wet cobalt precipitate as hereinbefore described and approximately about 140 gallons of wash liquors are also added to the large mixing tank equipped with a stirrer to give about 900 gallons of a reclaim solution containing about 3 percent by weight ammonia. The pH of the solution is adjusted to about 10 by the slow addition of lime. The resulting reclaim solution is fed into a conventional distillation column packed with corrosion resistant saddles. The feed stream enters the column at an intermediate section having an upper rectifying section and a lower stripping section. Ammonia enriched vapors are removed from the rectifying section and fed to a condensor wherein an ammonia solution comprising 28 percent by weight ammonia is produced. A bottom stream containing a precipitate is filtered to remove precipitated solids. The solids are analyzed as containing a hydrated cobalt, iron hydroxide and various other impurities. Heat for the distillation column is provided by injecting steam through a bottom opening at the rate of approximately 1.7 pounds of steam per gallon of feed. The removed solids are added to another original source of cobalt to be digested according to the basic process. The basic process together with the improvements as herein referred to above are repeated with similar results.

INDUSTRIAL APPLICABILITY

The method described and claimed herein is particularly useful in the formation of extra fine particle size cobalt powders of high purity, which is useful, for example, as a starting material in the formation of cemented carbides, e.g., tungsten carbide.

We claim:

1. A process for producing cobalt metal powder, the basic process comprising the steps of forming cobalt ions in solution, complexing said cobalt ions with ammonia in the presence of halide ions to form a cobalt ammine halide solution, digesting said cobalt ammine halide solution in the presence of ammonia to form a cobalt containing precipitate, separating said cobalt containing precipitate from the resulting solution, and heating cobalt containing precipitate in a reducing atmosphere to obtain a cobalt metal powder wherein the improvement comprises heating the resulting solution at a pH from about 7.5 to 14 at a sufficient temperature for a sufficient period of time to produce an ammonia enriched vapor and an aqueous mixture comprising a solution substantially free of ammonia and another cobalt containing precipitate.

2. A process for producing cobalt metal powder according to claim 1 wherein a sufficient amount of a basic material is added to said resulting solution to adjust the pH to a value of from about 7.5 to about 14.

3. A process for producing cobalt metal powder according to claim 2 wherein said other cobalt containing precipitate is added to the cobalt source of the basic process.

4. A process for producing cobalt metal powder according to claim 2 wherein prior to digesting, said basic process comprises acidifying said cobalt ammine halide solution to form a precipitate comprising cobalt ammine halide and separating said cobalt ammine halide precipitate from the solution containing impurities and combining said solution containing impurities with the resulting solution remaining after the formation of a cobalt containing precipitate.

5. A process for producing cobalt metal powder according to claim 4 wherein said cobalt ammine halide precipitate is dissolved to form a cobalt ammine halide solution.

6. A process for producing cobalt metal powder according to claim 5 wherein said cobalt ammine halide solution is purified by reprecipitating said cobalt ammine halide precipitate and separating said cobalt ammine halide precipitate from a solution containing additional impurities and combining said solution containing additional impurities with the resulting solution remaining after the formation of the cobalt containing precipitate, said purified cobalt ammine halide precipitate is dissolved to form a solution containing cobalt ammine complex ions, and said solution containing cobalt ammine complex ions is digested according to the basic process.

7. A process for producing cobalt metal powder according to claim 2 wherein said resulting solution remaining after the formation of the cobalt containing precipitate is treated with an alkali metal or alkaline earth metal hydroxide.

8. A process for producing cobalt metal powder according to claim 2 wherein the solution remaining after the formation of cobalt containing precipitate is fed to a distillation column and said heating comprises feeding steam into a lower portion of said column.

9. A process for producing cobalt metal powder according to claim 8 wherein said distillation column includes a rectifying section and a stripping section, and said process includes feeding ammonia vapor from the stripping section to a condenser and removing said solution substantially free of ammonia from said stripping solution.

* * * * *